US009844109B2

(12) United States Patent
Lee et al.

(10) Patent No.: US 9,844,109 B2
(45) Date of Patent: Dec. 12, 2017

(54) INFRARED CIRCUIT FOR SINGLE BATTERY AND REMOTE CONTROLLER USING THE SAME

(71) Applicant: Generalplus Technology Inc., Hsinchu (TW)

(72) Inventors: Hsin Chou Lee, Zhubei (TW); Ming-Hung Tsai, Feng Shan (TW)

(73) Assignee: Generalplus Technology Inc., Hsinchu (TW)

( * ) Notice: Subject to any disclaimer, the term of this patent is extended or adjusted under 35 U.S.C. 154(b) by 0 days.

(21) Appl. No.: 15/357,896

(22) Filed: Nov. 21, 2016

(65) Prior Publication Data

US 2017/0150563 A1 May 25, 2017

Related U.S. Application Data

(60) Provisional application No. 62/259,998, filed on Nov. 25, 2015.

(51) Int. Cl.

| | |
|---|---|
| ***H05B 41/26*** | (2006.01) |
| ***H05B 41/282*** | (2006.01) |
| ***H05B 37/02*** | (2006.01) |
| ***H05B 33/08*** | (2006.01) |

(52) U.S. Cl.

CPC ..... *H05B 33/0818* (2013.01); *H05B 33/0842* (2013.01); *H05B 37/0245* (2013.01)

(58) Field of Classification Search

USPC ..... 250/338.2, 493.1, 495.1, 504 H, 504 R; 323/220, 290, 355, 363; 362/84, 85, 157, 362/249.13, 551, 612; 361/264

See application file for complete search history.

(56) References Cited

U.S. PATENT DOCUMENTS

| | | | | |
|---|---|---|---|---|
| 8,491,151 | B2 * | 7/2013 | Spartano | F21L 4/027 315/291 |
| 2003/0151909 | A1 * | 8/2003 | Sid | H05B 37/0272 362/85 |
| 2010/0046211 | A1 * | 2/2010 | Spartano | F21L 4/027 362/157 |
| 2011/0309771 | A1 * | 12/2011 | Randall | H01G 5/014 315/307 |
| 2012/0026726 | A1 * | 2/2012 | Recker | F21K 9/13 362/157 |
| 2014/0111979 | A1 * | 4/2014 | Bushee | F21V 33/008 362/158 |

* cited by examiner

*Primary Examiner* — Bernard Souw

(74) *Attorney, Agent, or Firm* — Muncy, Geissler, Olds & Lowe, P.C.

(57) ABSTRACT

An infrared circuit for a single battery and a remote controller using the same are provided. The single battery outputs a battery voltage. The infrared circuit comprises an IR LED circuit, an inductor and a microcontroller. The IR LED circuit is coupled between the battery voltage and a common voltage. The inductor is coupled between the battery voltage and the common voltage. The microcontroller has an I/O port coupled to the inductor and the IR LED circuit. When infrared rays are emitted, the microcontroller controls the battery voltage to charge the inductor through the I/O port, and a continuous current of the inductor forces the IR LED circuit to turn on.

18 Claims, 9 Drawing Sheets

INFRARED CIRCUIT FOR SINGLE BATTERY AND REMOTE CONTROLLER USING THE SAME

BACKGROUND OF THE INVENTION

Field of the Invention

The invention relates to the infrared control technology, and more particularly to an infrared circuit for a single battery and a remote controller using the same.

Description of the Related Art

FIG. 1 is a circuit diagram showing a conventional device having an infrared emitting function. Referring to FIG. 1, the device having the infrared emitting function comprises a microcontroller 101, an IR LED 102 and at least two serially connected batteries 103. The microcontroller 101 has an input/output pin P01 coupled to an anode of the IR LED 102. The microcontroller 101 outputs a pulse signal PS to the IR LED 102 through the input/output pin P01.

In the prior art, the threshold voltage of the IR LED 102 ranges from 1.0V to 1.5V, and the ordinary battery has the voltage of about 1.5V when no load is present. A no-load voltage of an unused new battery may approach 1.65V, and the voltage of the battery continuously decreases with the use of the battery. The battery may be regarded as failed after the voltage thereof is lower than 1.0V or 0.9V. When the battery is coupled to the load, the voltage thereof is decreased with the increase of the output current, and is often decreased to the voltage between 1.1V and 1.3V when an ordinary load is applied. The voltage of one battery may be higher than or lower than a threshold voltage of an infrared emitting tube. When the voltage is higher than the threshold voltage, the exceeded voltage value is too low. Thus, the current flowing through the IR LED is smaller, thereby causing the too-short emitting distance that cannot be accepted by the user. In addition, when the battery is used for a period of time, the voltage of the battery is lower than the threshold voltage of the IR LED. At this time, the IR LED cannot emit the infrared rays. Thus, the device with the infrared emitting function typically needs at least two batteries connected in series.

SUMMARY OF THE INVENTION

An object of the invention is to provide an infrared circuit for a single battery and a remote controller using the same, wherein only one single battery is used to drive an IR LED circuit having a threshold voltage equal to about a voltage of the battery.

In view of this, the invention provides an infrared circuit to be driven by only one single battery, which outputs a battery voltage. The infrared circuit comprises an IR LED circuit, an inductor and a microcontroller. The IR LED circuit is coupled between the battery voltage and a common voltage. The inductor is coupled between the battery voltage and the common voltage. An I/O port of the microcontroller is coupled to the inductor and the IR LED circuit. When infrared rays are emitted, the microcontroller controls the battery voltage to charge the inductor through the I/O port, and utilizes a continuous current of the inductor to force the IR LED circuit to turn on.

The invention further provides a remote controller comprising one single battery and an infrared circuit for the single battery. The single battery outputs a battery voltage. The infrared circuit comprises an IR LED circuit, an inductor and a microcontroller. The IR LED circuit is coupled between the battery voltage and a common voltage. The inductor is coupled between the battery voltage and the common voltage. An I/O port of the microcontroller is coupled to the inductor and the IR LED circuit. When a button is pressed down, the microcontroller controls the IR LED circuit to emit infrared rays according to the pressed button. When the infrared rays are emitted, the microcontroller controls the battery voltage to charge the inductor through the I/O port, and utilizes a continuous current of the inductor to force the IR LED circuit to turn on.

In the infrared circuit for the single battery and the remote controller using the same according to the preferred embodiment of the invention, the inductor comprises a first end and a second end, and the IR LED circuit comprises an anode end and a cathode end. The first end of the inductor is coupled to the battery voltage, and the second end of the inductor is coupled to the I/O port of the microcontroller. The anode end of the IR LED circuit is coupled to the I/O port of the microcontroller, and the cathode end of the IR LED circuit is coupled to the common voltage. When the infrared rays are emitted, the microcontroller controls the I/O port to output the common voltage, and then the microcontroller configures the I/O port as having high impedance, so that the energy stored in the inductor flows through the IR LED circuit.

In the infrared circuit for the single battery and the remote controller using the same according to the preferred embodiment of the invention, the inductor comprises a first end and a second end, and the IR LED circuit comprises an anode end and a cathode end. The first end of the inductor is coupled to the common voltage, the second end of the inductor is coupled to the I/O port of the microcontroller, the anode end of the IR LED circuit is coupled to the battery voltage, and the cathode end of the IR LED circuit is coupled to the I/O port of the microcontroller. When the infrared rays are emitted, the microcontroller controls the I/O port to output a power voltage, and then the microcontroller configures the I/O port as having high impedance, so that the energy stored in the inductor flows through the IR LED circuit.

In the infrared circuit for the single battery and the remote controller using the same according to the preferred embodiment of the invention, the inductor comprises a first end and a second end, and the IR LED circuit comprises an anode end and a cathode end. The first end of the inductor is coupled to the battery voltage, the second end of the inductor is coupled to the I/O port of the microcontroller, the cathode end of the IR LED circuit is coupled to the battery voltage, and the anode end of the IR LED circuit is coupled to the I/O port of the microcontroller. A common voltage end of the microcontroller is coupled to the common voltage. When the infrared rays are emitted, the microcontroller controls the I/O port to output a common voltage, and then the microcontroller configures the I/O port as having high impedance, so that the energy stored in the inductor flows through the IR LED circuit.

The essence of the invention is to utilize the inductor to store the energy. In addition, the current of the inductor must be continuous, thereby forcing the energy stored by the inductor to flow through the IR LED circuit. Thus, even if one single battery is used, the IR LED circuit may also be driven through the inductor. Even if the voltage of the single battery is smaller than the threshold voltage of the IR LED circuit, the IR LED circuit also can be driven through the inductor.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

DETAILED DESCRIPTION OF THE INVENTION

Figure 1:
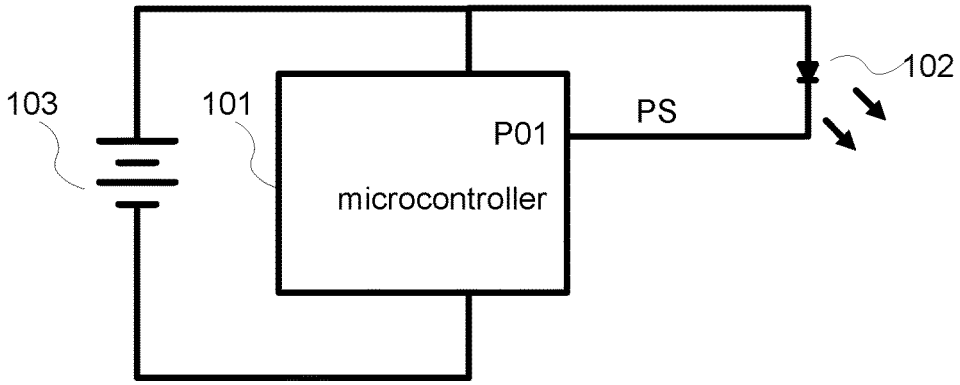
FIG. 1 (Prior Art)
FIG. 1 is a circuit diagram showing a conventional device having an infrared emitting function.
Figure 2:
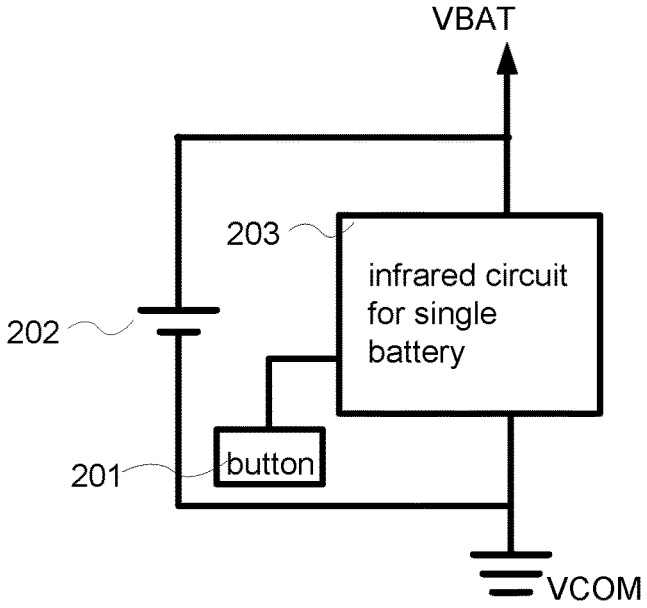
FIG. 2 is a circuit diagram showing a remote controller according to a preferred embodiment of the invention.
Figure 3:
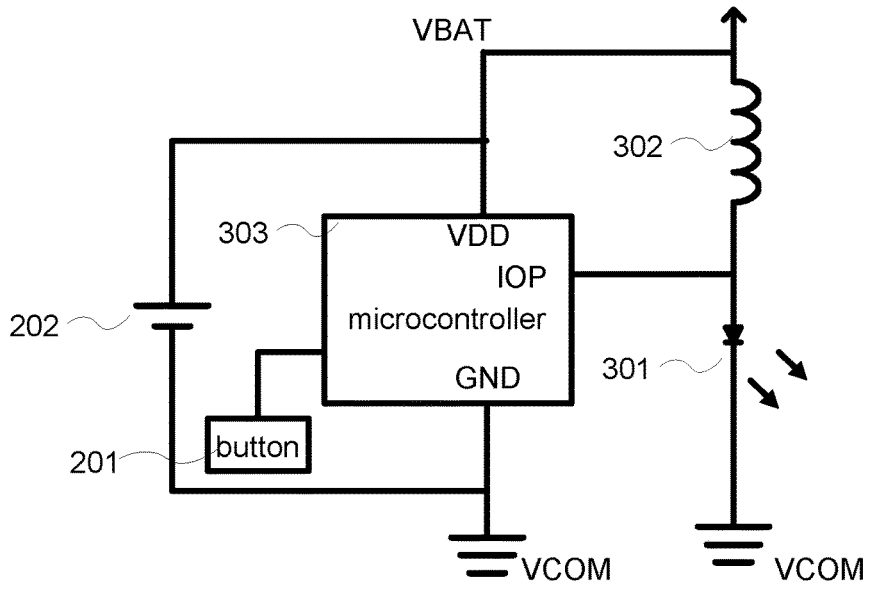
FIG. 3 is a circuit diagram showing an infrared circuit 203 for one single battery according to a preferred embodiment of the invention.

FIG. 2 is a circuit diagram showing a remote controller according to a preferred embodiment of the invention. Referring to FIG. 2, the remote controller comprises a button 201 or a set of buttons 201, a single battery 202 and an infrared (IR) circuit 203 for one single battery according to the embodiment of the invention. FIG. 3 is a circuit diagram showing the infrared circuit 203 for the one single battery according to a preferred embodiment of the invention. Referring to FIG. 3, the infrared circuit 203 comprises an IR light-emitting diode (LED) circuit 301, an inductor 302 and a microcontroller 303. In addition, for the sake of description, FIG. 3 also shows the single battery 202 and the button 201. The button 201 is coupled to the microcontroller 303. An anode of the IR LED circuit 301 is coupled to an I/O port IOP of the microcontroller 303. A cathode of the IR LED circuit 301 is coupled to a common voltage VCOM. In this embodiment, a threshold voltage of the IR LED circuit 301 is higher than a battery voltage VBAT. A first end of the inductor 302 is coupled to the battery voltage VBAT, and a second end of the inductor 302 is coupled to the I/O port IOP of the microcontroller 303. A power source end VDD of the microcontroller 303 is coupled to the battery voltage VBAT, and the ground GND of the microcontroller 303 is coupled to the common voltage VCOM.

Figure 4:
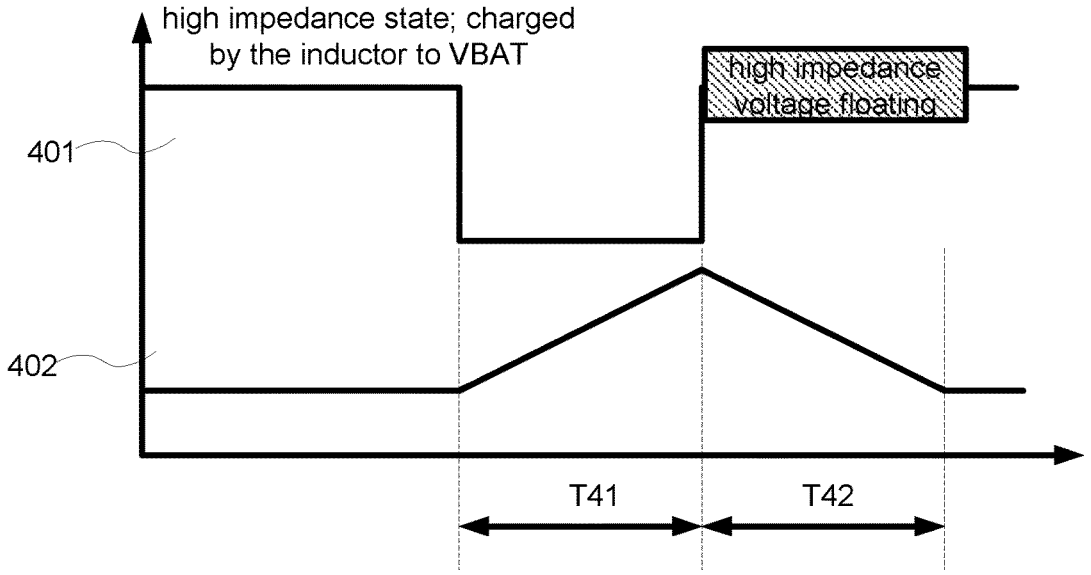
FIG. 4 shows an operation waveform chart of the infrared circuit 203 for one single battery according to a preferred embodiment of the invention.
Figure 4A:
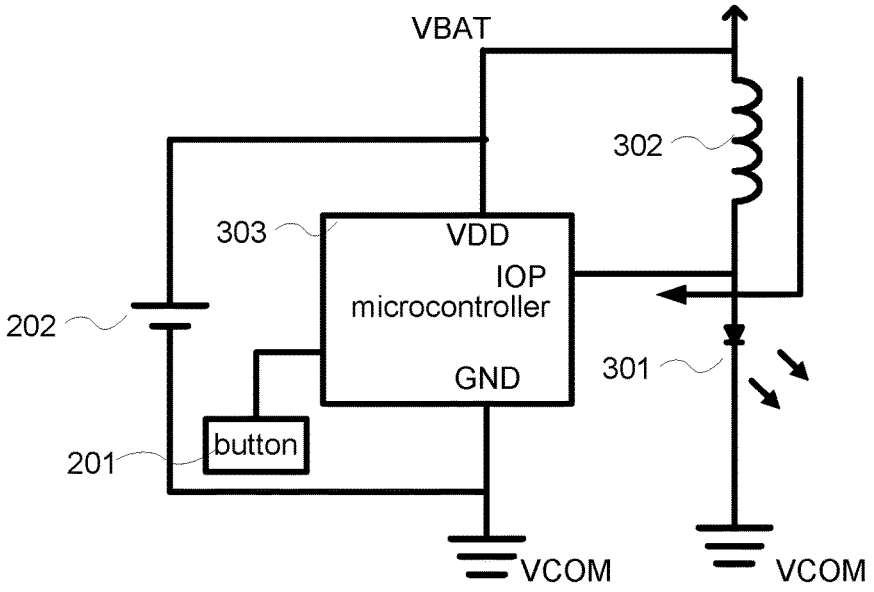
FIG. 4A is a schematic view showing a current of the infrared circuit 203 during the time T41 according to a preferred embodiment of the invention.

FIG. 4 shows an operation waveform chart of the infrared circuit 203 for one single battery according to a preferred embodiment of the invention. Referring to FIG. 4, in order to simplify the description, it is assumed that the button 201 generally outputs a series of infrared pulses when the button 201 is pressed down. For the sake of explanation in this embodiment, the infrared circuit 203 outputs one infrared pulse. A waveform 401 represents the waveform of the I/O port IOP of the microcontroller 303; and a waveform 402 represents a current waveform of the inductor 302. When the button 201 is pressed down, the microcontroller 303 controls the I/O port to switch from a high impedance state to a logic low voltage. At this time, charging of the inductor 302 starts. During the time T41, the current of the inductor 302 linearly rises. During this time, the current IL of the inductor 302 is shown in FIG. 4A. FIG. 4A is a schematic view showing a current of the infrared circuit 203 during the time T41 according to a preferred embodiment of the invention.

Figure 4B:
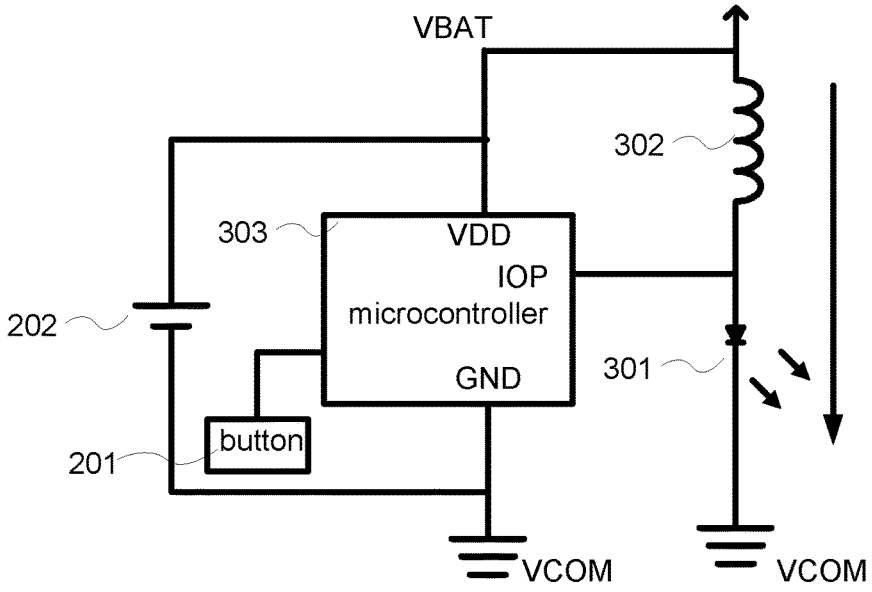
FIG. 4B is a schematic view showing a current of the infrared circuit 203 during the time T42 according to a preferred embodiment of the invention.

When the I/O port IOP switches from the logic low voltage to the high impedance state, the current of the inductor 302 needs to be continuous. So, during the time T42, the current of the inductor 302 flows from the anode of the IR LED circuit 301 to the common voltage VCOM, and the current of the inductor 302 linearly decreases. During this time, the current IL of the inductor 302 is shown in FIG. 4B. FIG. 4B is a schematic view showing a current of the infrared circuit 203 during the time T42 according to a preferred embodiment of the invention. Thus, even if only one single battery 201 is used, the IR LED circuit 301 still can be driven to emit the infrared signal.

Figure 5:
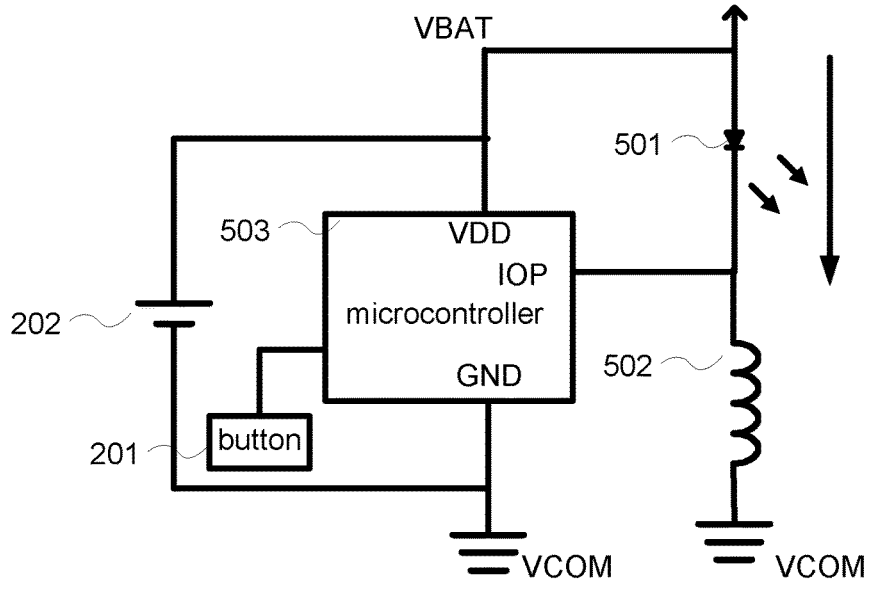
FIG. 5 is a circuit diagram showing the infrared circuit 203 for one single battery according to a preferred embodiment of the invention.

FIG. 5 is a circuit diagram showing the infrared circuit 203 for one single battery according to a preferred embodiment of the invention. Referring to FIG. 5, the infrared circuit 203 for one single battery comprises an IR LED circuit 501, an inductor 502 and a microcontroller 503, In addition, for the sake of description, FIG. 5 further depicts the single battery 202 and the button 201. The button 201 is coupled to the microcontroller 503. An anode of the IR LED circuit 501 is coupled to the battery voltage VBAT, and a cathode of the IR LED circuit 501 is coupled to an I/O port IOP of the microcontroller 503. A first end of the inductor 502 is coupled to the I/O port IOP of the microcontroller 503, and a second end of the inductor 502 is coupled to the common voltage VCOM. A power source end VDD of the microcontroller 503 is coupled to the battery voltage VBAT, and a ground GND of the microcontroller 503 is coupled to the common voltage VCOM.

Figure 6:
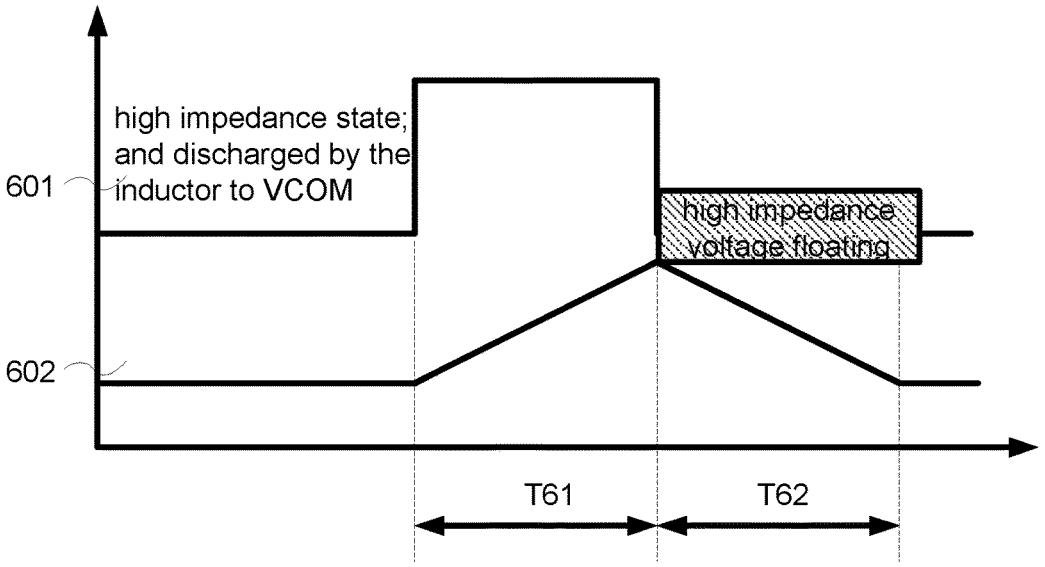
FIG. 6 shows an operation waveform chart of the infrared circuit 203 according to a preferred embodiment of the invention.
Figure 6A:
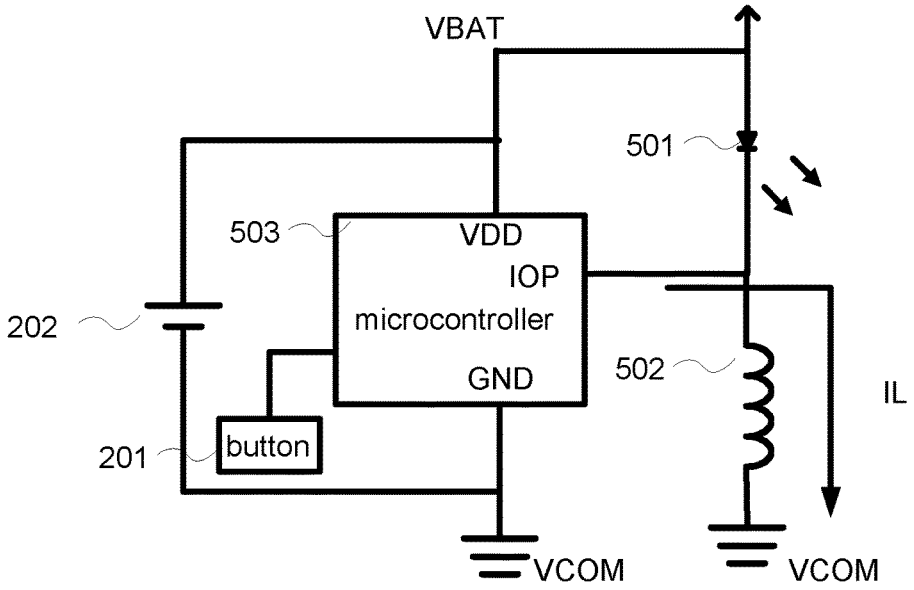
FIG. 6A is a schematic view showing a current of the infrared circuit 203 during the time T61 according to a preferred embodiment of the invention.

FIG. 6 shows an operation waveform chart of the infrared circuit 203 according to a preferred embodiment of the invention. Referring to FIG. 6, in order to simplify the description, it is assumed that the button 201 generally outputs a series of infrared pulses when the button 201 is pressed down. In this embodiment, for the sake of explanation, the infrared circuit 203 for one single battery outputs one infrared pulse. A waveform 601 represents a waveform of the I/O port IOP of the microcontroller 503; and a waveform 602 represents a current waveform of the inductor 502. When the button 201 is pressed down, the microcontroller 503 controls the I/O port to switch from the high impedance state to the logic high voltage. At this time, charging of the inductor 502 starts, and the current linearly rises during the time T61. During this time, a current IL of the inductor 502 is shown in FIG. 6A. FIG. 6A is a schematic view showing a current of the infrared circuit 203 during the time T61 according to a preferred embodiment of the invention.

Figure 6B:
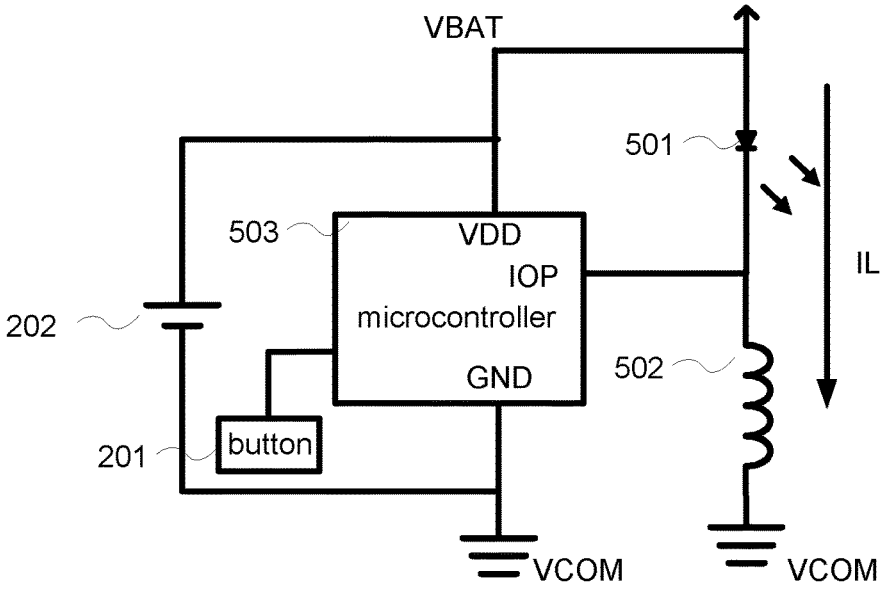
FIG. 6B is a schematic view showing a current of the infrared circuit 203 during the time T62 according to a preferred embodiment of the invention.

When the I/O port IOP switches from the logic high voltage to the high impedance state, the current of the inductor 502 flows from the anode of the IR LED circuit 501 to the common voltage VCOM, and the current of the inductor 502 linearly decreases during the time T62 because the current of the inductor 502 needs to be continuous. During this time, the current IL of the inductor 502 is shown in FIG. 6B. FIG. 6B is a schematic view showing a current of the infrared circuit 203 during the time T62 according to a preferred embodiment of the invention. Thus, even if only one single battery 201 is used, the IR LED circuit 501 also can be driven to emit the infrared signal.

Figure 7:
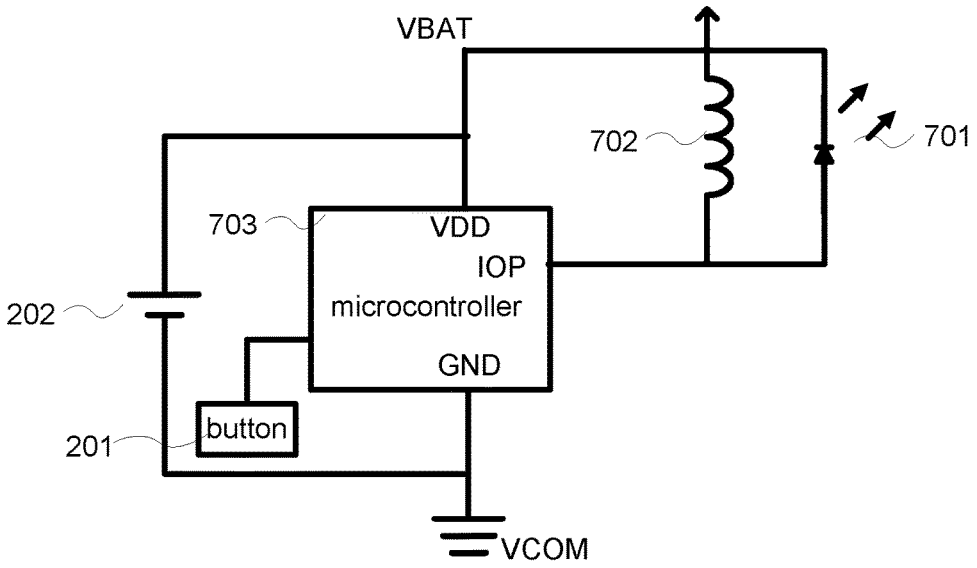
FIG. 7 is a circuit diagram showing the infrared circuit 203 for one single battery according to a preferred embodiment of the invention.

FIG. 7 is a circuit diagram showing the infrared circuit 203 for one single battery according to a preferred embodiment of the invention. Referring to FIG. 7, the infrared circuit 203 for one single battery comprises an IR LED circuit 701, an inductor 702 and a microcontroller 703. In addition, for the sake of description, FIG. 7 further depicts the single battery 202 and the button 201. The button 201 is coupled to the microcontroller 703. The anode of the IR LED circuit 701 is coupled to the I/O port IOP of the microcontroller 703, and the cathode of the IR LED circuit 701 is coupled to the battery voltage VBAT. The first end of the inductor 702 is coupled to the battery voltage VBAT, and the second end of the inductor 702 is coupled to the I/O port IOP of the microcontroller 703. The power source end VDD of the microcontroller 703 is coupled to the battery voltage VBAT, and the ground GND of the microcontroller 703 is coupled to the common voltage VCOM.

Figure 8:
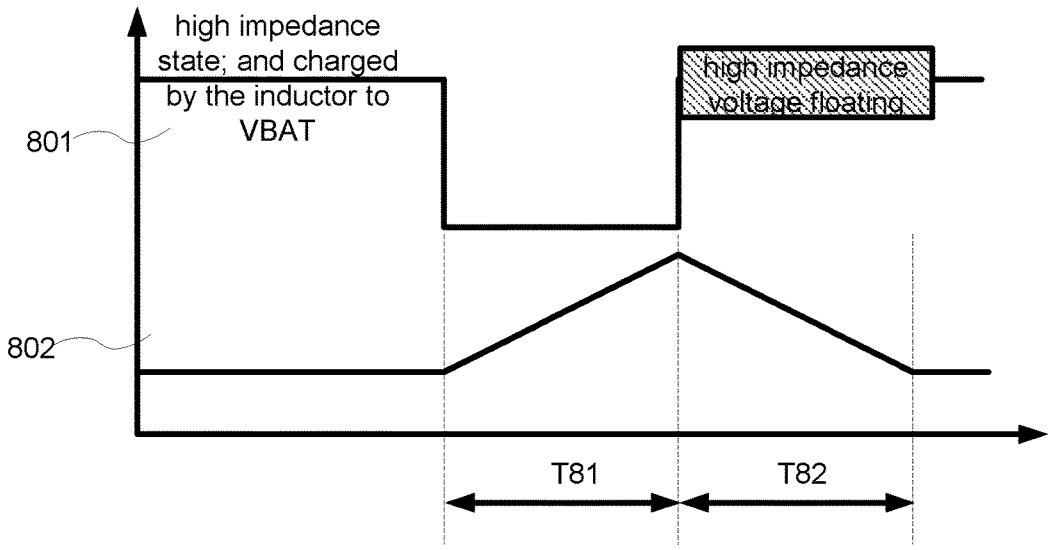
FIG. 8 shows an operation waveform chart of the infrared circuit 203 according to a preferred embodiment of the invention.
Figure 8A:
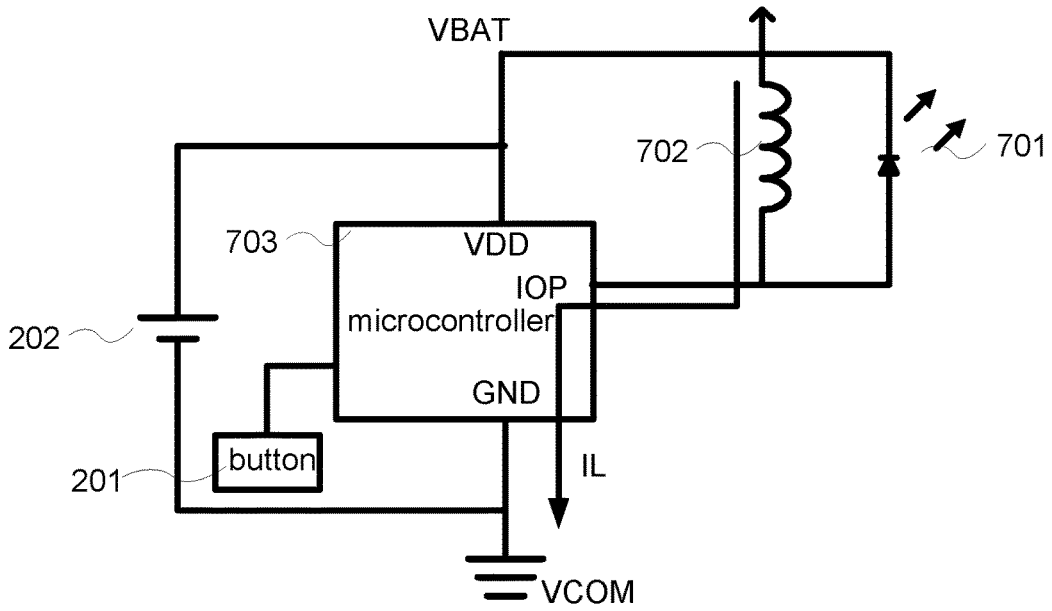
FIG. 8A is a schematic view showing a current of the infrared circuit 203 during the time T81 according to a preferred embodiment of the invention.

FIG. 8 shows an operation waveform chart of the infrared circuit 203 according to a preferred embodiment of the invention. Referring to FIG. 8, in order to simplify the description, it is assumed that when the button 201 is pressed down, a series of infrared pulses are generally outputted. In this embodiment, for the sake of explanation, the infrared circuit 203 for one single battery outputs one infrared pulse. A waveform 801 represents a waveform of the I/O port IOP of the microcontroller 703; and a waveform 802 represents a current waveform of the inductor 702. When the button 201 is pressed down, the microcontroller 703 controls the I/O port to switch from a high impedance state to a logic low voltage. At this time, charging of the inductor 702 starts. During the time T81, the current linearly rises. During this time, the current IL of the inductor 702 is shown in FIG. 8A. FIG. 8A is a schematic view showing a current of the infrared circuit 203 during the time T81 according to a preferred embodiment of the invention.

Figure 8B:
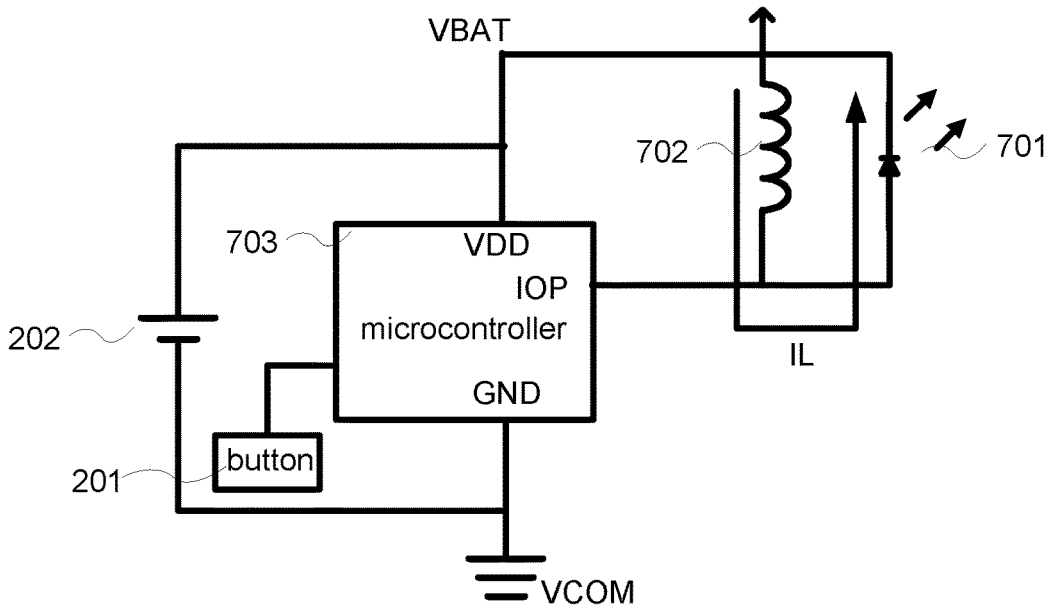
FIG. 8B is a schematic view showing a current of the infrared circuit 203 during the time T82 according to a preferred embodiment of the invention.

When the I/O port IOP switches from the logic low voltage to the high impedance state, because the current of the inductor 702 needs to be continuous, the current of the inductor 702 flows from the anode of the IR LED circuit 701 to the battery voltage VBAT, and the current of the inductor 702 linearly decreases during the time T82. During this time, the current IL of the inductor 702 is shown in FIG. 8B. FIG. 8B is a schematic view showing a current of the infrared circuit 203 during the time T82 according to a preferred embodiment of the invention. Thus, even if only one single battery 201 is used, the IR LED circuit 701 may also be driven to emit the infrared signal.

Although the above-mentioned three embodiments have different connection relationships, the inductor is utilized to store the energy and then release the energy to turn on the IR LED circuit to output the infrared rays in a basic manner. Any modification, in which the IR LED circuit is coupled between the battery voltage VBAT and the common voltage VCOM, the inductor is coupled between the battery voltage VBAT and the common voltage VCOM, the microcontroller controls the battery voltage VBAT to charge the inductor through the I/O port when infrared rays are emitted, and a continuous current of the inductor forces the IR LED circuit to turn on, is regarded as falling within the scope of the invention. So, the invention is not restricted to the above-mentioned three embodiments.

Figure 9:
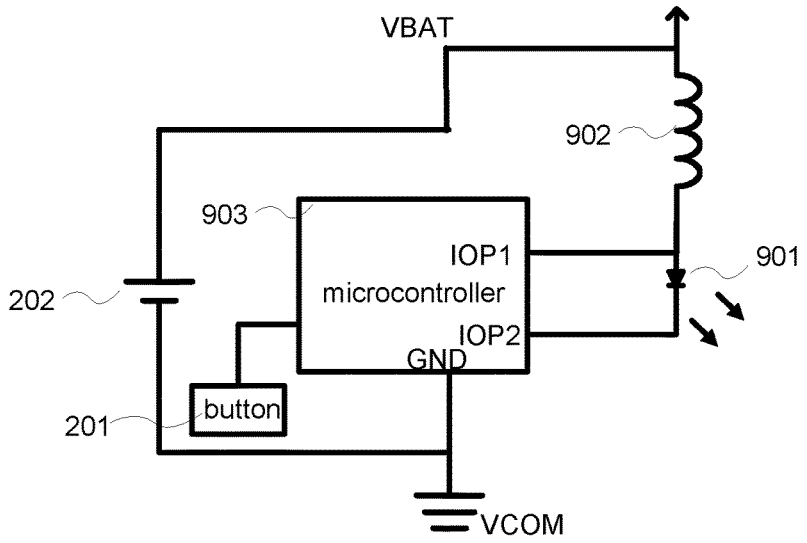
FIG. 9 is a circuit diagram showing the infrared circuit 203 for one single battery according to a preferred embodiment of the invention.

FIG. 9 is a circuit diagram showing the infrared circuit 203 for one single battery according to a preferred embodiment of the invention. Referring to FIGS. 9 and 3, the difference between the embodiments of FIGS. 9 and 3 resides in that a microcontroller 903 in the embodiment of FIG. 9 has no power source end VDD, and that the microcontroller 903 has a first I/O port IOP1 and a second I/O port IOP2. In addition, a cathode of the IR LED 901 is coupled to the second I/O port IOP2 of the microcontroller 903. An inductor 902 is similarly coupled between the battery voltage VBAT and the first I/O port IOP1 of the microcontroller 903. In this embodiment, the microcontroller 903 receives the electric power for working through its first I/O port IOP1.

Figure 10:
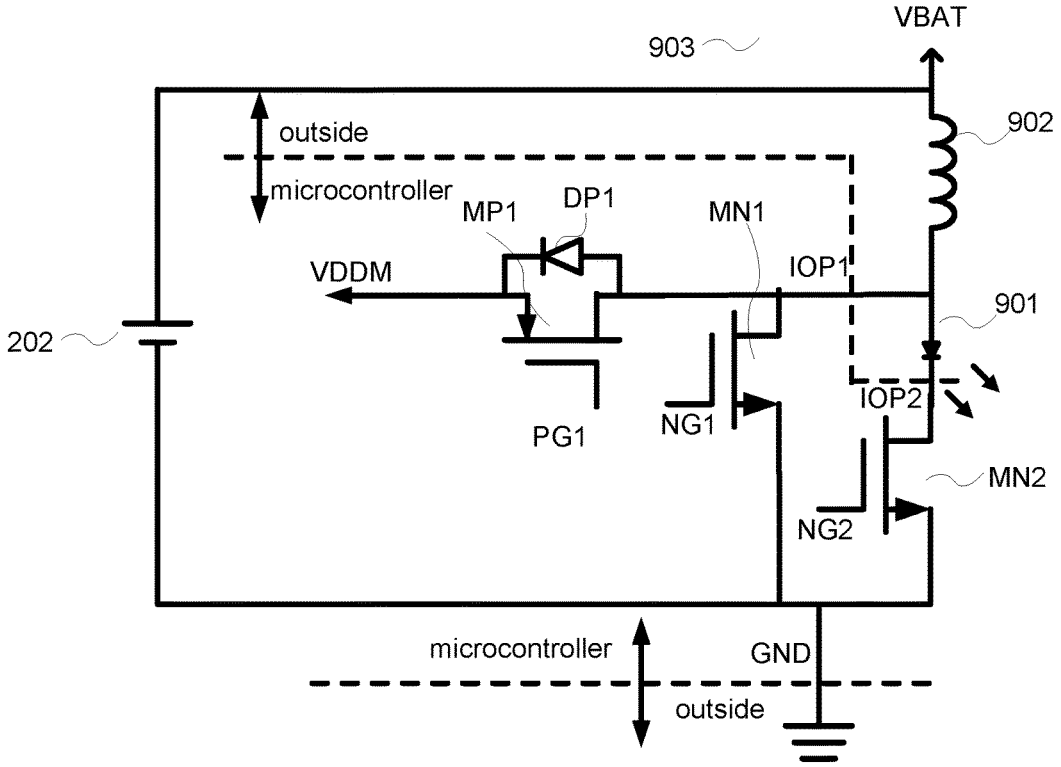
FIG. 10 is a detailed circuit diagram showing the infrared circuit 203 for one single battery according to a preferred embodiment of the invention.

FIG. 10 is a detailed circuit diagram showing the infrared circuit 203 for one single battery according to a preferred embodiment of the invention. Referring to FIG. 10, the inside of the dashed line is the inside of the microcontroller 903, and the outside of the dashed line is the external circuit. In this embodiment, the microcontroller 903 has a P-type metal-oxide-semiconductor field-effect transistor (MOSFET) MP1, a first N-type MOSFET MN1 and a second N-type MOSFET MN2, wherein the P-type MOSFET MP1 has a parasitic diode DP1.

Figure 11:
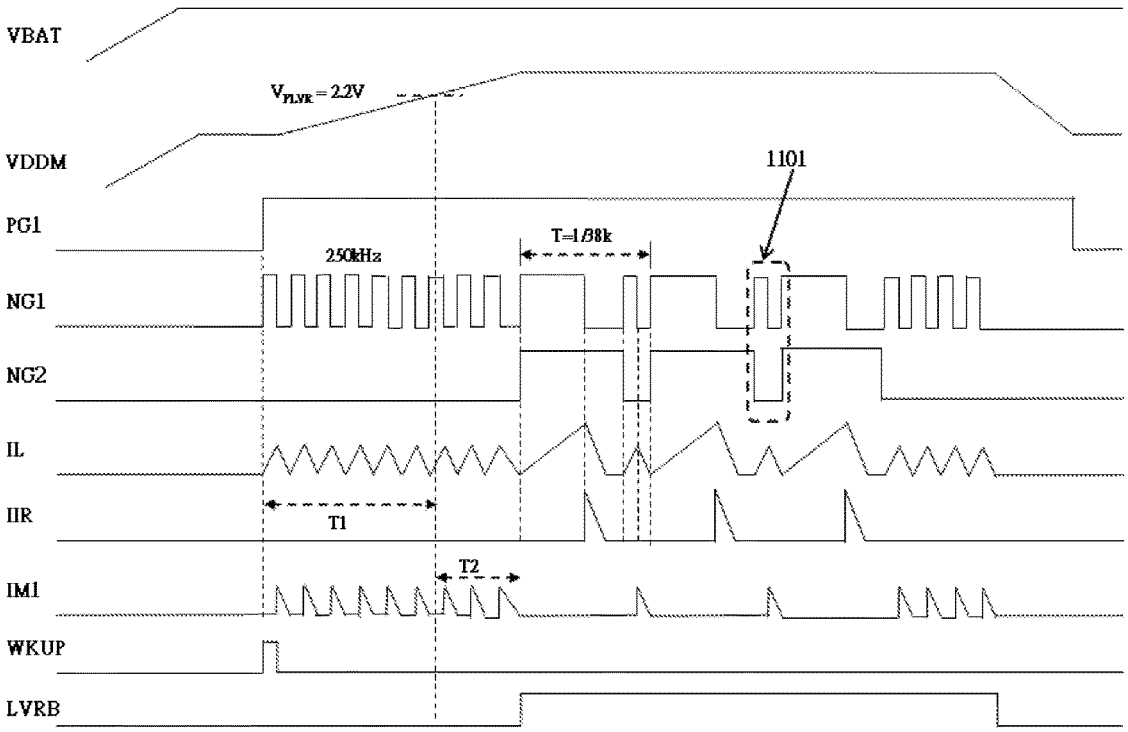
FIG. 11 shows an operation waveform chart of the infrared circuit 203 of FIG. 10 according to a preferred embodiment of the invention.

FIG. 11 shows an operation waveform chart of the infrared circuit 203 of FIG. 10 according to a preferred embodiment of the invention. Referring to FIGS. 10 and 11, VBAT represents a battery voltage; VDDM represents a power voltage of the microcontroller 903; PG1 represents a signal given to the gate of the P-type MOSFET MP1; NG1 represents a signal given to the gate of the first N-type MOSFET MN1; NG2 represents a signal given to the gate of the second N-type MOSFET MN1; IL represents a current flowing through the inductor 902; IIR represents a current flowing through the IR LED 901; IMP represents a current flowing through the P-type MOSFET MP1; WKUP represents a wake-up enable signal of the microcontroller 903; and LVRB represents a low voltage reset signal.

Similarly, it is assumed that the infrared circuit 203 for one single battery is an infrared ray remote controller. When no remote control operation is performed, the microcontroller 903 is in a standby state, and the operation voltage thereof only needs to be 0.9V. When the user presses the button, a wake-up signal WKUP is enabled. At this time, the gate of the first N-type MOSFET MN1 is given with a switch signal NG1 of the frequency of 250 KHz, and the gate of the second N-type MOSFET MN2 is given with the logic low voltage NG2, so the second N-type MOSFET MN2 is in an off state. When the first N-type MOSFET MN1 turns off, the current of the inductor 902 charges the power voltage VDDM of the microcontroller 903 through the parasitic diode DP1 of the P-type MOSFET MP1.

After the time T1 has elapsed and when the power voltage of the microcontroller 903 VDDM is charged to 2.2V, waiting is performed for the time T2, and then the low voltage reset signal LVRB is enabled and the microcontroller 903 is reset. Thereafter, the transmission of the remote control signal of 38 KHz starts. When the transmission of the remote control signal of 38 KHz starts, the second N-type MOSFET MN2 is turned on. At this time, the gate of the first N-type MOSFET MN1 is given with the switch signal NG1 of the frequency 38 KHz. Because the second N-type MOSFET MN2 is turned on, the current of the inductor 902 flows to the IR LED 901 to emit the IR optical signal. Also, please refer to the symbol 1101. In each period the second N-type MOSFET MN2 is turned off, the gate of the first N-type MOSFET MN1 is given with the switch signal NG1 (short pulse) of the frequency 250 KHz. Thus, the inductor can charge the power voltage VDDM of the microcontroller 903.

When the signal output is completed, the low voltage reset signal LVRB is switched from the logic high voltage to the logic low voltage, the switching of the switch signal NG1 given to the gate of the first N-type MOSFET MN1 and the switch signal NG2 given to the second N-type MOSFET MN2 stops, and the microcontroller 903 again returns to the standby state.

The more special property is that the microcontroller 903 of this embodiment does not need additional power voltage pins. The microcontroller 903 utilizes the first N-type MOSFET MN1 inside the first I/O port IOP1 to switch to make the inductor continuously charge/discharge, so that the microcontroller 903 can obtain the enough power voltage. In addition, the power voltage of the microcontroller 903 is again charged each time after the remote control signal of 38 KHz is transmitted in the above-mentioned embodiment. However, this implementation is only the preferred implementation. If the power voltage is stable, it is not necessary to charge the power voltage of the microcontroller 903 each time after the remote control signal of 38 KHz is transmitted. The invention is not restricted thereto. Furthermore, although the above-mentioned embodiment charges the microcontroller with the frequency of 250 KHz, those skilled in the art should know that the frequency relates to the inductance or other parameters, and is unnecessary to be kept at 250 KHz. So, the invention is not restricted thereto. Similarly, although 38 KHz is the frequency of the existing infrared receiver, the invention can also be applied to other applications. If other frequency bands are used in other applications, the invention may also be implemented at other frequencies. So, the invention is not restricted thereto.

In summary, the essence of the invention is to utilize the inductor to store the energy. In addition, because the current of the inductor needs to be continuous, the stored energy is forced to flow through the IR LED circuit. Thus, even if one single battery is used, the IR LED circuit also can be driven through the inductor. Even if the battery voltage of the single battery is lower than the threshold voltage of the IR LED circuit, the IR LED circuit also can be driven through the inductor.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An infrared (IR) circuit to be driven by only one single battery, which outputs a battery voltage, the infrared circuit comprising:

an IR light-emitting diode (LED) circuit coupled between the battery voltage and a common voltage;

an inductor coupled between the battery voltage and the common voltage; and a microcontroller comprising an input/output (I/O) port coupled to the inductor and the IR LED circuit, wherein, when infrared rays are emitted, the microcontroller controls the battery voltage to charge the inductor through the I/O port, and utilizes a continuous current of the inductor to force the IR LED circuit to turn on.

2. The infrared circuit according to claim 1, wherein the inductor comprises a first end and a second end, the IR LED circuit comprises an anode end and a cathode end, the first end of the inductor is coupled to the battery voltage, the second end of the inductor is coupled to the I/O port of the microcontroller, the anode end of the IR LED circuit is coupled the I/O port of the microcontroller, and the cathode end of the IR LED circuit is coupled to the common voltage.

3. The infrared circuit according to claim 2, wherein when the infrared rays are emitted, the microcontroller controls the I/O port to output the common voltage, and then the microcontroller configures the I/O port as having high impedance, so that energy stored in the inductor flows through the IR LED circuit.

4. The infrared circuit according to claim 1, wherein the inductor comprises a first end and a second end, the IR LED circuit comprises an anode end and a cathode end, the first end of the inductor is coupled to the common voltage, the second end of the inductor is coupled to the I/O port of the microcontroller, the anode end of the IR LED circuit is coupled to the battery voltage, and the cathode end of the IR LED circuit is coupled to the I/O port of the microcontroller.

5. The infrared circuit according to claim 4, wherein when the infrared rays are emitted, the microcontroller controls the I/O port to output a power voltage, and then the microcontroller configures the I/O port as having high impedance, so that energy stored in the inductor flows through the IR LED circuit.

6. The infrared circuit according to claim 1, wherein the inductor comprises a first end and a second end, the IR LED circuit comprises an anode end and a cathode end, the first end of the inductor is coupled to the battery voltage, the second end of the inductor is coupled to the I/O port of the microcontroller, the cathode end of the IR LED circuit is coupled to the battery voltage, and the anode end of the IR LED circuit is coupled to the I/O port of the microcontroller, wherein a common voltage end of the microcontroller is coupled to the common voltage.

7. The infrared circuit according to claim 6, wherein when the infrared rays are emitted, the microcontroller controls the I/O port to output the common voltage, and then the microcontroller configures the I/O port as having high impedance, so that energy stored in the inductor flows through the IR LED circuit.

8. The infrared circuit according to claim 1, wherein the microcontroller comprises a second I/O port, wherein, the inductor comprises a first end and a second end, the IR LED circuit comprises an anode end and a cathode end, the first end of the inductor is coupled to the battery voltage, the second end of the inductor is coupled to the I/O port of the microcontroller, the anode end of the IR LED circuit is coupled to the I/O port of the microcontroller, and the cathode end of the IR LED circuit is coupled to a second I/O port of the microcontroller, wherein the I/O port of the microcontroller comprises:

a first switch, comprising a control end, a first end and a second end, wherein the control end of the first switch receives a first control signal inside the microcontroller, to control on and off states between the first end of the first switch and the second end of the first switch, the first end of the first switch is coupled to the I/O port, and the second end of the first switch is coupled to the common voltage end; and a unidirectional conductive element comprising a first end and a second end, wherein the first end of the unidirectional conductive element is coupled to the I/O port, and the second end of the unidirectional conductive element is coupled to a power voltage of the microcontroller;

wherein the second I/O port of the microcontroller comprises:

a second switch comprising a control end, a first end and a second end, wherein the control end of the second switch receive a second control signal from the microcontroller, to control on and off states between the first end of the second switch and the second end of the second switch, the first end of the second switch is coupled to the second I/O port, and the second end of the second switch is coupled to the common voltage end;

wherein when the microcontroller is waken up, the microcontroller controls the second control signal to turn off the second switch, and the microcontroller controls the first control signal to control switching of the first switch by a charging frequency to charge the power voltage of the microcontroller, wherein when infrared data is transmitted, the microcontroller controls the second switch to turn on, the microcontroller controls a frequency and a logic voltage of the first control signal according to the infrared data, and controls the on and off states between the first end and the second end of the first switch to make the IR LED circuit output the infrared data.

9. The infrared circuit according to claim 8, wherein when the infrared data is transmitted and the second switch turns off, the microcontroller controls the first control signal to operate at the charging frequency, and controls the first switch to switch to charge the power voltage of the microcontroller.

10. A remote controller, comprising:

a button;

a single battery outputting a battery voltage; and an infrared circuit for the single battery, comprising:

an IR LED circuit coupled between the battery voltage and a common voltage;

an inductor coupled between the battery voltage and the common voltage; and a microcontroller, which is coupled to the button and comprises an I/O port, wherein the I/O port of the microcontroller is coupled to the inductor and the IR LED circuit, wherein, when the button is pressed down, the microcontroller controls the IR LED circuit to emit infrared rays according to the pressed button, wherein, when the infrared rays are emitted, the microcontroller controls the battery voltage to charge the inductor through the I/O port, and utilizes a continuous current of the inductor to force the IR LED circuit to turn on.

11. The remote controller according to claim 10, wherein the inductor comprises a first end and a second end, the IR LED circuit comprises an anode end and a cathode end, the first end of the inductor is coupled to the battery voltage, the second end of the inductor is coupled to the I/O port of the microcontroller, the anode end of the IR LED circuit is coupled to the I/O port of the microcontroller, and the cathode end of the IR LED circuit is coupled to the common voltage.

12. The remote controller according to claim 11, wherein when the infrared rays are emitted, the microcontroller controls the I/O port to output the common voltage, and then the microcontroller configures the I/O port as having high impedance, so that energy stored in the inductor flows through the IR LED circuit.

13. The remote controller according to claim 10, wherein the inductor comprises a first end and a second end, the IR LED circuit comprises an anode end and a cathode end, the first end of the inductor is coupled to the common voltage, the second end of the inductor is coupled to the I/O port of the microcontroller, the anode end of the IR LED circuit is coupled to the battery voltage, and the cathode end of the IR LED circuit is coupled to the I/O port of the microcontroller.

14. The remote controller according to claim 13, wherein when the infrared rays are emitted, the microcontroller controls the I/O port to output a power voltage, and then the microcontroller configures the I/O port as having high impedance, so that energy stored in the inductor flows through the IR LED circuit.

15. The remote controller according to claim 10, wherein the inductor comprises a first end and a second end, the IR LED circuit comprises an anode end and a cathode end, the first end of the inductor is coupled to the battery voltage, the second end of the inductor is coupled to the I/O port of the microcontroller, the cathode end of the IR LED circuit is coupled to the battery voltage, and the anode end of the IR LED circuit is coupled to the I/O port of the microcontroller, wherein a common voltage end of the microcontroller is coupled to the common voltage.

16. The remote controller according to claim 15, wherein when the infrared rays are emitted, the microcontroller controls the I/O port to output the common voltage, and then the microcontroller configures the I/O port as having high impedance, so that energy stored in the inductor flows through the IR LED circuit.

17. The remote controller according to claim 10, wherein the microcontroller comprises a second I/O port, wherein, the inductor comprises a first end and a second end, the IR LED circuit comprises an anode end and a cathode end, the first end of the inductor is coupled to the battery voltage, the second end of the inductor is coupled to the I/O port of the microcontroller, the anode end of the IR LED circuit is coupled to the I/O port of the microcontroller, and the cathode end of the IR LED circuit is coupled to a second I/O port of the microcontroller, wherein the I/O port of the microcontroller comprises:

a first switch comprising a control end, a first end and a second end, wherein the control end of the first switch receives a first control signal inside the microcontroller to control on and off states between the first end of the first switch and the second end of the first switch, the first end of the first switch is coupled to the I/O port, and the second end of the first switch is coupled to the common voltage end; and a unidirectional conductive element comprising a first end and a second end, wherein the first end of the unidirectional conductive element is coupled to the I/O port, and the second end of the unidirectional conductive element is coupled to a power voltage of the microcontroller;

wherein the second I/O port of the microcontroller comprises:

a second switch comprising a control end, a first end and a second end wherein the control end of the second switch receives a second control signal from the microcontroller to control on and off states between the first end of the second switch and the second end of the second switch, the first end of the second switch is coupled to the second I/O port, and the second end of the second switch is coupled to the common voltage end;

wherein when the microcontroller is waken up, the microcontroller controls the second control signal to turn off the second switch, and the microcontroller controls the first control signal to control switching of the first switch by a charging frequency to charge a power voltage of the microcontroller, wherein when infrared data is transmitted, the microcontroller controls the second switch to turn on, and the microcontroller controls a frequency and a logic voltage of the first control signal according to the infrared data, and controls the on and off states between the first end and the second end of the first switch to make the IR LED circuit output the infrared data.

18. The remote controller according to claim 17, wherein when the infrared data is transmitted and the second switch turns off, the microcontroller controls the first control signal to operate at the charging frequency and controls the first switch to switch to charge the power voltage of the microcontroller.

* * * * *